United States Patent [19]

Ogawa

[11] Patent Number: 4,855,694

[45] Date of Patent: Aug. 8, 1989

[54] LUMPED ELEMENT CIRCULATOR HAVING A CONDUCTIVE PEDESTAL FRAME STRUCTURE

[75] Inventor: Hiroshi Ogawa, Tokyo, Japan

[73] Assignee: Nec Corporation, Tokyo, Japan

[21] Appl. No.: 200,102

[22] Filed: May 31, 1988

[30] Foreign Application Priority Data

May 29, 1987 [JP] Japan ..... 62-134632

[51] Int. Cl.[4] ..... H01P 1/387

[52] U.S. Cl. ..... 333/1.1; 333/238

[58] Field of Search ..... 333/1.1

[56] References Cited

U.S. PATENT DOCUMENTS 3,551,853 12/1970 Konishi ..... 333/1.1

FOREIGN PATENT DOCUMENTS 2246114 5/1975 France ..... 333/1.1

39610 4/1981 Japan ..... 333/1.1

*Primary Examiner*—Paul Gensler

*Attorney, Agent, or Firm*—Sughrue, Mion, Zinn, Macpeak & Seas

[57] ABSTRACT

A lumped element circulator comprises a dielectric substrate having a conductive layer on an upper center portion of its upper surface and a lower conductive layer entirely on its lower surface. A conductive pedestal frame structure is soldered to the upper conductive layer of the dielectric substrate on the outer periphery of a ferromagnetic substrate secured to the upper conductive layer of the dielectric substrate. Capacitors are mounted in recesses formed on the pedestal frame structure. A plurality of overcrossing parallel conductive strip lines extend in pairs across the ferromagnetic substrate with 120 degrees angular separation at their centers. One end of each strip line pair is short-circuited by a terminating conductor located substantially on the same horizontal plane as the upper electrodes of the capacitors and connected thereto, allowing them to be interconnected by short connecting leads and further to input/output ports. The other end of each strip line pair is short-circuited by a second terminating conductor which is connected by a short connecting lead to the upper surface of the pedestal frame structure.

3 Claims, 3 Drawing Sheets

LUMPED ELEMENT CIRCULATOR HAVING A CONDUCTIVE PEDESTAL FRAME STRUCTURE

BACKGROUND OF THE INVENTION

The present invention relates to a lumped element circulator for use in the microwave frequency region.

A microwave circulator is a device useful for interconnecting microwave components. It can be used as an isolator for aiding in matching microwave components so that reflected signals do not interfere with transmission. A conventional lumped element microwave circulator is advantageous because of its reduced construction. It comprises a dielectric substrate and a ferromagnetic substrate which is formed on a metallized surface of the dielectric substrate. A set of three overcrossing pairs of parallel conductive strip lines extend across the ferromagnetic substrate with 120 degrees angular separation from each other, each end of the pairs being short-circuited. One end of each strip line pair is connected by a first coupling lead to one of a plurality of capacitors and thence to an associated input/output port and the other end of each strip line pair is connected by a second coupling lead to the metallized surface of the dielectric substrate. Resonance is established by each strip line pair and the associated capacitor.

However, the conventional lumped element circulator is still not satisfactory in terms of its operating frequency range. Broadband lumped element circulators capable of high frequency operation are desired for use in a variety of applications.

SUMMARY OF THE INVENTION

It is therefore an object of the present invention to provide a broadband lumped element circulator.

The present invention is based on the discovery that with the conventional lumped element circulator the connecting leads used for coupling the ends of each strip line pair to adjacent components exhibit a substantial amount of inductive reactance which creates a leakage path for high frequency electromagnetic field, resulting in a lowering of the "filling factor", a ratio of permeability due to clockwise field component to permeability due to counterclockwise field component. This arises from the fact that the dielectric of each capacitor has a thickness much smaller than the thickness of the ferromagnetic substrate, and therefore the first connecting leads must extend over a substantial length. Likewise, the second connecting leads must also be of substantial length for establishing the necessary connection to the underlying conductive layer.

Accordingly, another object of the present invention is to provide a lumped element circulator having a high "filling factor".

The lumped element circulator of the invention comprises a dielectric substrate having an upper conductive layer on a center portion of its upper surface and a lower conductive layer covering entirely its lower surface. A conductive pedestal frame structure is soldered to the upper conductive layer of the dielectric substrate and surrounds the outer periphery of a ferromagnetic substrate which is secured to the upper conductive layer of the dielectric substrate. Capacitors are mounted in recesses formed on the pedestal frame structure. A plurality of overcrossing parallel conductive strip lines are provided in pairs, extending across the ferromagnetic substrate with 120 degrees angular separation at their centers. Each end of the strip line pairs is shortcircuited by first and second terminating conductors. The first terminating conductors of the strip lines are located at a vertical position equal to the position of the upper electrodes of the capacitors and connected thereto by short connecting leads and further connected to input/output ports. The second terminating conductors are also connected by short connecting leads to the upper surface of the pedestal frame structure. Since the pedestal frame structure has a substantially equal vertical dimension to the thickness of the ferromagnetic substrate, each of the first and second connecting leads extends over a minimum length, minimizing the undesired inductive components of the circulator.

Thus, a further object of the present invention is provide a lumped element circulator which facilitates bonding work associated with the connecting leads and facilitates capacitor trimming.

BRIEF DESCRIPTION OF THE DRAWINGS

The present invention will be described in further detail with reference to the accompanying drawings, in which.

DETAILED DESCRIPTION

Figure 1:
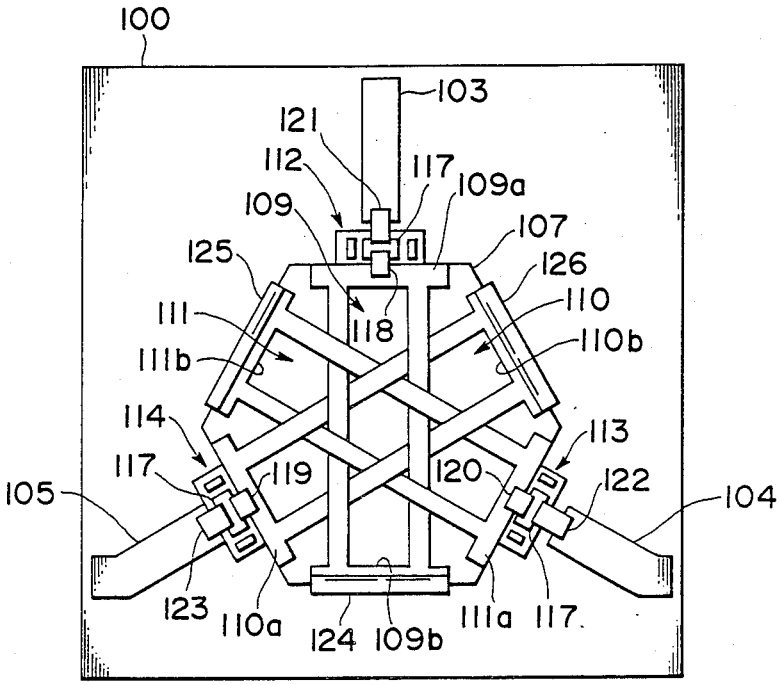
FIG.1 (PRIOR ART)
FIG. 1 is a plan view of a prior art lumped element circulator.
Figure 2:
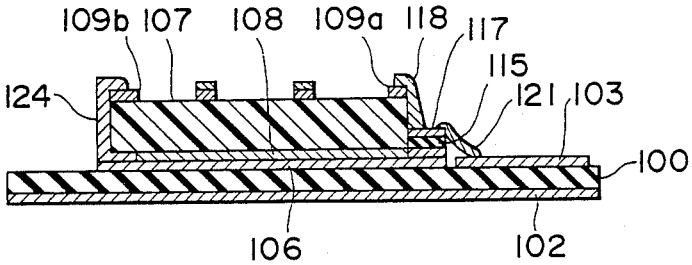
FIG.2 (PRIOR ART)
FIG. 2 is a cross-sectional view taken along the lines 2—2 of FIG. 1.

Before going into the detail of the present invention it is appropriate to describe the prior art lumped element circulator with reference to FIGS. 1 and 2. The prior art circulator comprises a dielectric substrate 100 having a lower conductive layer 102 and an upper conductive layer 106. A ferrite substrate 107 having a conductive layer 108 is soldered to the conductive layer 106. On the upper surface of the ferrite substrate 107 are three pairs of overcrossing parallel conductive strip lines 109, 110 and 111 arranged at 120° angular separation from each other. Each end of each of the strip line pairs 109,110 and 111 is shorted circuited as shown at **109*a*, 109*b*, 110*a*, 110*b*, 111*a* and 111b. Adjacent to the short-circuited ends 109*a*, 110*a* and 111*a* are capacitors 112, 113 and 114 each having a dielectric 115 with a thickness much smaller than the thickness of the ferrite substrate 107. The upper electrodes 117 of these capacitors are respectively coupled to the shortcircuited ends 109*a*, 110*a*, 111*a* by means of conductors 118, 119 and 120 and further connected by conductors 121, 122 and 123 to input/output ports 103, 104 and 105, respectively. The other short-circuited ends 109*b*,110*b* and 111*b* are connected by conductors 124, 125 and 126, respectively, to the conductive layer 106. Strip lines 109, 110 and 111 and capacitors 112, 113 and 114 are combined to establish resonances at a desired frequency. To obtain desired reactance characteristics, the thicknesses of the ferrite substrate 107 and dielectric 115 of each capacitor are controlled. Since there is a gap between the upper electrodes 117 of each capacitor and the upper surface of the ferrite substrate 107, conductors 118, 119 and 120** has a substantial length to establish connection between each of the short-circuited ends 109*a*, 110*a* and 111*a* and the electrodes 117, tending to exhibit a substantial amount of inductances. This applies to conductors 124, 125 and 126.

Since the broad-banding of the lumped element circulator of this type is achieved by increasing the "filling factor" which is represented by the ratio of permeability of the clockwise component of electromagnetic field to the permeability of the counterclockwise component of the field, it is important that the high frequency magnetic field be contained within the ferrite substrate 107 with a minimum of leakage. However, the inductances exhibited by such lengthy conductors result in a reduction of the "filling factor", making it difficult to realize the broad-banding of the circulator.

Figure 3:
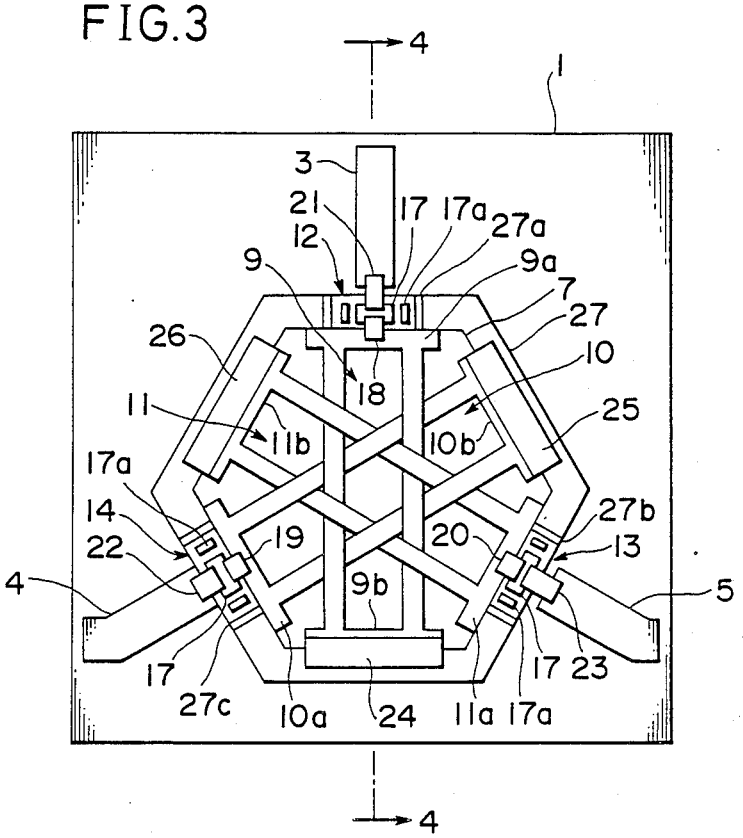
FIG. 3 is a plan view of a lumped element circulator according to the present invention.
Figure 4:
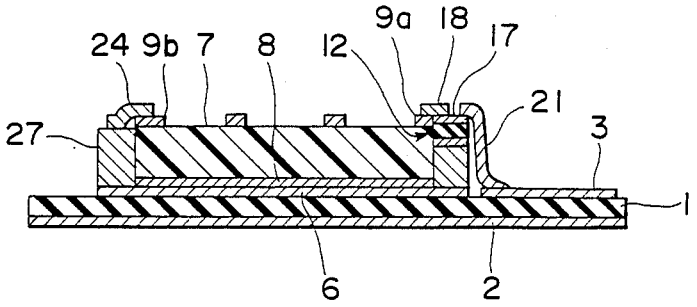
FIG. 4 is a cross-sectional view taken along the lines 4—4 of FIG. 3.
Figure 5:
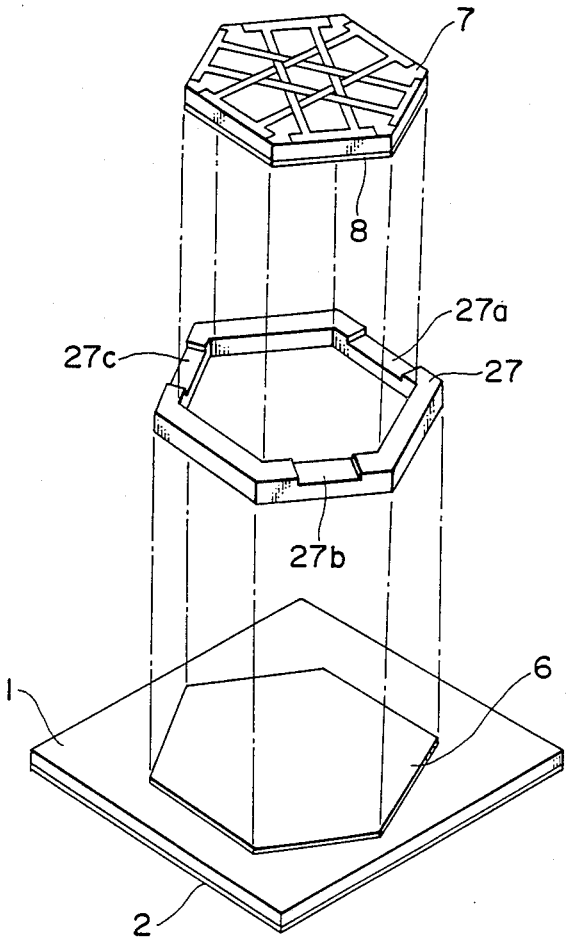
FIG. 5 is an exploded, perspective view of the circulator of this invention.

Referring now to FIGS. 3, 4 and 5, a lumped element circulator of the present invention is illustrated. The lumped element circulator of this invention comprises a dielectric substrate 1 on the bottom of which is formed a conductive layer 2. On the center portion of its upper surface is formed a conductive layer 6 of hexagonal shape as seen in FIG. 5 to exhibit a capacitance with the conductive layer 2 and the dielectric substrate 1 in between. On the conductive layer 6 is soldered a hexagon-shaped conductive pedestal frame structure 27 so that the outer peripheries of frame 27 are aligned with those of the hexagon shaped underlying conductive layer 6. Pedestal frame 27 is formed with recesses 27*a*, 27*b* and 27*c* on the upper surface of alternate sides of the hexagon for accommodating capacitors 12, 13 and 14, with their lower electrodes 16 being soldered to the bottom of each recess. For trimming each of the capacitors 12, 13, 14, a pair of auxiliary electrodes 17*a* are provided one on each side of an upper electrode 17.

A ferromagnetic substrate 7 having a bottom surface metallized with a conductive layer 8 is snugly disposed within the hexagonal pedestal frame structure 27. The vertical dimension of the frame 27 is substantially equal to the total thickness of the ferromagnetic substrate 7 and its conductive layer 8 combined so that they present a flat surface on their upper sides.

Three sets of over-crossing parallel conductive strip lines are provided in pairs 9, 10 and 11. These conductive strip lines are soldered to the upper surface of the hexagonal ferromagnetic substrate 7 and arranged with 120° angular separation between them. Each of these pairs extends from one side of the hexagon to the opposite side with insulations being provided so that each overcrosses one upon another. The opposite ends of the strip line pair 9 are short-circuited by conductors 9*a* and 9*b*. Likewise, strip line pairs 10 and 11 are short-circuited at their opposite ends by conductors 10*a*, 10*b*, 11*a* and 11*b*.

The upper electrodes 17 of the capacitors 12, 13 and 14 are connected by conductors 18, 19 and 20 to the end conductors 9*a*, 10*a* and 11*a*, respectively, on the one hand and further connected by conductors 21, 22, and 23 to the input/output ports 3, 4 and 5, respectively, on the other hand. The end conductors 9*b*, 10*b* and 11*b* of the parallel strip lines are connected by conductors 24, 25 and 26, respectively, to the upper surface of the metallic frame 27.

The depth of each of the recesses 27*a*, 27*b*, 27*c* is dimensioned so that the upper electrodes 17 of the capacitors 12, 13, 14 are flush with the upper surface of the end conductors 9*a*, 10*a*, 11*a*. Thus, the connecting leads 18, 19 and 20 can be made significantly shorter than is required with the prior art circulator. This is also true of the connecting leads 24, 25 and 26.

Therefore, the inductances associated with these connecting leads 18 to 20, 24 to 26 are significantly reduced in comparison with the prior art circulator. Since the portions of the circulator where these connecting leads must be soldered are located substantially on an equal flat plane, bonding work can be facilitated and the trimming of the respective capacitors 12, 13 and 14 with the use of auxiliary electrodes 17a can also be facilitated.

The foregoing description shows only one preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A lumped element circulator comprising:

a dielectric substrate having upper and lower conductive layers respectively on opposite surfaces of the substrate;

a conductive pedestal frame structure having a bottom surface thereof being soldered to said upper conductive layer and having a plurality of recesses on an upper surface thereof;

a ferromagnetic substrate disposed within said pedestal frame structure and having a substantially equal thickness to a vertical dimension of said pedestal frame structure;

a plurality of overcrossing parallel conductive strip lines in pairs extending across an upper surface of said ferromagnetic substrate at 120 degrees angles to each other, each pair being short circuited at opposite ends thereof by first and second terminating conductors, said first terminating conductors being respectively adjacent to said recesses;

a plurality of capacitors respectively disposed in said recesses, each of said capacitors comprising a dielectric having a thickness smaller than the thickness of said ferromagnetic substrate and upper and lower electrodes on the opposite sides of said dielectric, said lower electrodes being soldered to the bottom of said recesses and the upper electrodes being substantially flush with the upper surface of said pedestal frame structure;

a plurality of first connecting leads electrically connecting said first terminating conductors to said upper electrodes;

a plurality of second connecting leads electrically connecting said second terminating conductors to the upper surface of said conductive frame structure; and a plurality of input/output ports on said dielectric substrate and respectively electrically connected to said upper electrodes.

2. A lumped element circulator as claimed in claim 1, wherein said conductive frame structure is in the shape of a hexagon.

3. A lumped element circulator as claimed in claim 1, wherein each of said capacitors is provided with an auxiliary electrode adjacent to the second electrode for trimming the capacitance thereof.

* * * * *